US008578730B2

(12) United States Patent
Ashrafzadeh et al.

(10) Patent No.: US 8,578,730 B2
(45) Date of Patent: Nov. 12, 2013

(54) REFRIGERATOR ICE AND LIQUID DISPENSER INCORPORATING IMAGING SYSTEM

(75) Inventors: Farhad Ashrafzadeh, Stevensville, MI (US); Kevin M. Chase, Saint Joseph, MI (US); Brian P. Janke, Ann Arbor, MI (US); Shreecharan Kanchanavally, Lisle, IL (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1108 days.

(21) Appl. No.: 12/550,774

(22) Filed: Aug. 31, 2009

(65) Prior Publication Data

US 2011/0048056 A1 Mar. 3, 2011

(51) Int. Cl.
*F25D 3/00* (2006.01)
*G06K 9/34* (2006.01)

(52) U.S. Cl.
USPC ..... 62/389; 382/164; 382/165

(58) Field of Classification Search
CPC ..... F25D 25/00; F25C 5/005; G06T 7/0081; G06T 7/408; G06K 9/4652
USPC ..... 62/389; 141/198; 382/164, 165, 115, 382/110
See application file for complete search history.

(56) References Cited

U.S. PATENT DOCUMENTS

| | | | | |
|---|---|---|---|---|
| 3,640,089 | A | 2/1972 | Frazier | |
| 3,837,587 | A | 9/1974 | Walter et al. | |
| 4,890,651 | A * | 1/1990 | Stembridge et al. | 141/1 |
| 5,860,564 | A | 1/1999 | Jablonski | |
| 6,607,096 | B2 | 8/2003 | Glass et al. | |
| 7,007,500 | B2 | 3/2006 | Lee | |
| 7,035,456 | B2 | 4/2006 | Lestideau | |
| 7,418,983 | B2 * | 9/2008 | Mizuno et al. | 141/94 |
| 8,109,301 | B1 * | 2/2012 | Denise | 141/360 |
| 2006/0112715 | A1 | 6/2006 | Chung | |
| 2007/0064986 | A1 * | 3/2007 | Johnson | 382/128 |
| 2007/0119204 | A1 | 5/2007 | Kwon | |
| 2007/0152076 | A1 * | 7/2007 | Chiang et al. | 236/94 |
| 2007/0256442 | A1 | 11/2007 | Lyvers et al. | |
| 2008/0053138 | A1 | 3/2008 | Ryu et al. | |

FOREIGN PATENT DOCUMENTS

| | | | |
|---|---|---|---|
| JP | 63235217 | A | 9/1988 |
| JP | 4165278 | A | 6/1992 |

* cited by examiner

*Primary Examiner* — Cassey D Bauer

(57) ABSTRACT

A safety system for an ice and liquid dispenser of a refrigerator is used to sense the presence of human skin in a dispensing well. The safety system includes a digital image capture device focused on a dispenser well for capturing images of objects, such as hands, in the dispenser well and a digital image analyzer operatively coupled to the digital image capture device. The digital image analyzer evaluates the digital images captured by the digital image capture device to determine if human skin color is detected in the image of the object in the dispensing well. If human skin color is detected, thus indicating a hand in the dispensing area, any dispensing operation will be prevented and an alert will be provided.

17 Claims, 5 Drawing Sheets

REFRIGERATOR ICE AND LIQUID DISPENSER INCORPORATING IMAGING SYSTEM

BACKGROUND OF THE INVENTION

1. Field of the Invention

The present invention pertains to the art of refrigerators and, more particularly, to incorporating an imaging system for a refrigerator ice and liquid dispenser.

2. Description of the Related Art

Modern refrigeration mechanisms, such as refrigerator/freezer units, have electrically powered actuators that perform a variety of functions. An example is an ice maker/dispenser. Normally, electrical motors perform functions such as operating valves to supply water to the ice maker, moving a rod or rack to eject ice that has been frozen from supplied water, and moving other structure to convey, alter or direct ice pieces to an ice delivery or dispensing chute.

In the case of an ice maker/dispenser, a user normally must manually push a button with a finger or move a glass or container against a lever to actuate a motor to dispense ice down the chute. In some models, the user can also manually push a button to select between ice cubes or crushed ice and, in some instances, shaved ice. Normally, once actuated, the dispenser operates until the user releases the button or lever. In some cases, the dispenser motor continues until automatically stopped by a timer.

In either of these cases, there are situations where it may be desirable to activate a warning signal or provide some form of notification when an unusual activity occurs during a dispensing operation. For example, if a child reaches into the ice dispensing area or the ice dispensing chute, it may be appropriate to provide a signal to the child or a nearby adult. To this end, it would be advantageous to automatically detect the presence of a human hand and activate a warning signal until the situation can be resolved. This would be particularly advantageous in refrigerators that have an ice crushing system located just above the ice chute.

One example of a solution to the aforementioned problem is disclosed in U.S. Pat. No. 3,640,089 to Frazier. The Frazier patent discloses a dispenser and crusher having a safety system for stopping operation of the dispenser and crusher upon the thrusting of an arm or other elongated member into a chute region. The safety system includes a proximity detection circuit having a sensing plate associated with the ice passage. However, Frazier does not distinguish between a human hand and other objects that may be inserted into the ice chute.

Regardless of the existence of various known devices and methods for detecting foreign objects in an ice chute, there is still a need for further advancements in ice and liquid dispenser control. More specifically, there exists a need for a more versatile ice and liquid dispenser safety system that employs digital imaging technology and which is capable of sensing the presence of human skin, thus a human hand, in the dispensing area.

SUMMARY OF THE INVENTION

The present invention is concerned with a refrigerator including a cabinet having top, bottom, rear and opposing side walls that collectively define a refrigerator body having a freezer compartment. The refrigerator further includes a door mounted to the cabinet for selectively providing access to the freezer compartment. The freezer compartment is provided with an ice maker, with the formed ice being stored in an ice cube storage bin. An ice crushing mechanism and ice chute are provided below the ice storage bin for dispensing ice to a service station. In accordance with the invention, the refrigerator employs an ice and liquid dispensing control system that utilizes digital images to determine if a person has inserted his or her hand into the dispensing station.

More specifically, the ice and liquid dispensing control system employs a digital image capture device which is focused upon a well of the dispensing station. The digital image capture device captures digital images of objects that enter an upper region of the dispensing well. The digital images are sent to a digital image analyzing system that analyzes the image to determine if human skin color is present in the image.

In further accordance with the present invention, if the digital image capture device determines that human skin color is present in the image, a controller signals a user interface to generate audible or visual notifications that a person has inserted his or her hand into an upper region of the ice and liquid dispensing well.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
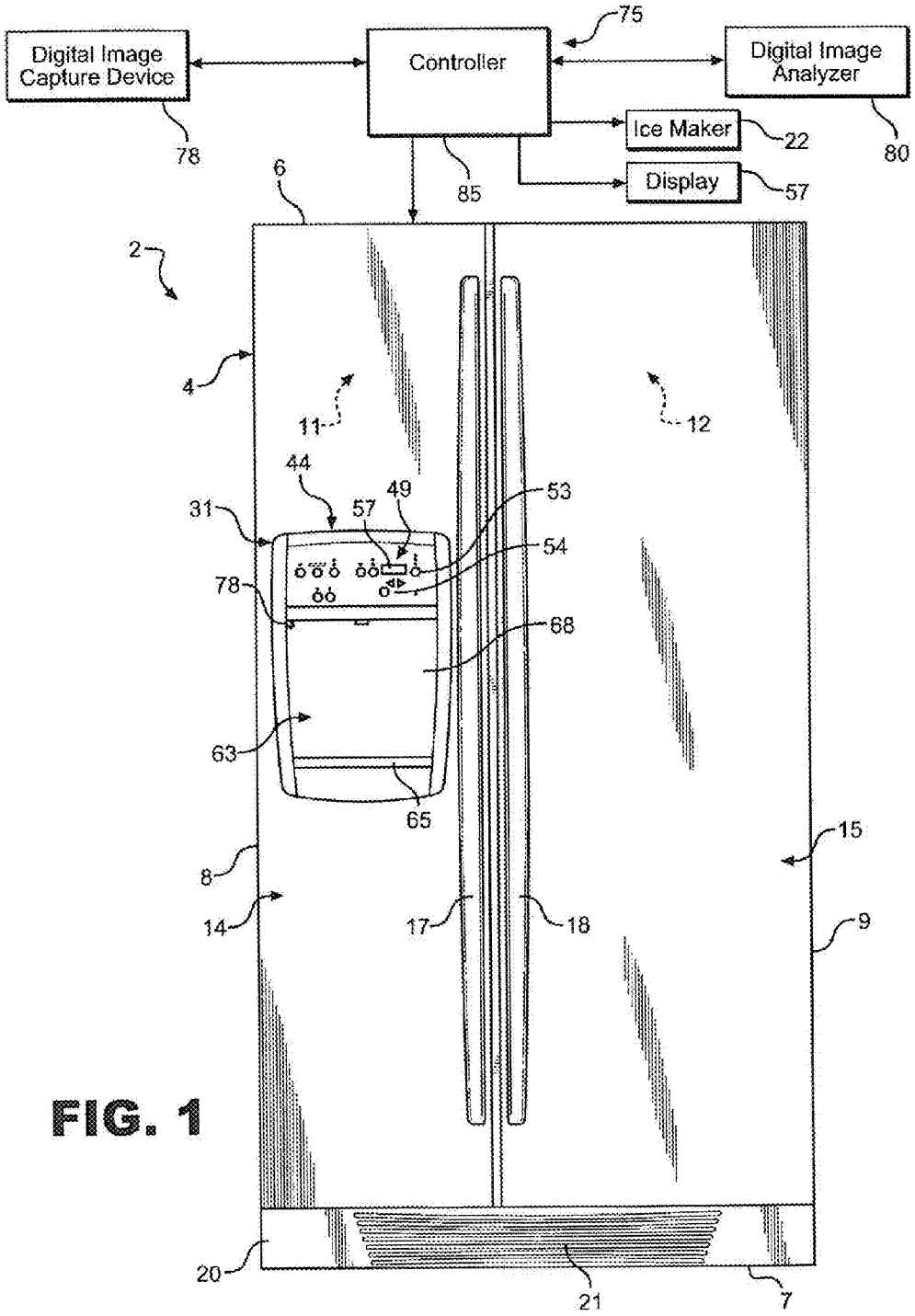
FIG. 1 is a front elevational view of a refrigerator incorporating an ice and liquid dispensing system incorporating an imaging system constructed in accordance with the present invention.

With initial reference to FIG. 1, a refrigerator constructed in accordance with the present invention is generally indicated at 2. Refrigerator 2 includes a cabinet 4 having a top wall 6, a bottom 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14, 15 includes an associated handle 17, 18. Refrigerator 2 is also shown to include a kick plate 20 arranged at a bottom portion thereof having a vent 21 that permits air to flow into refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

Figure 2:
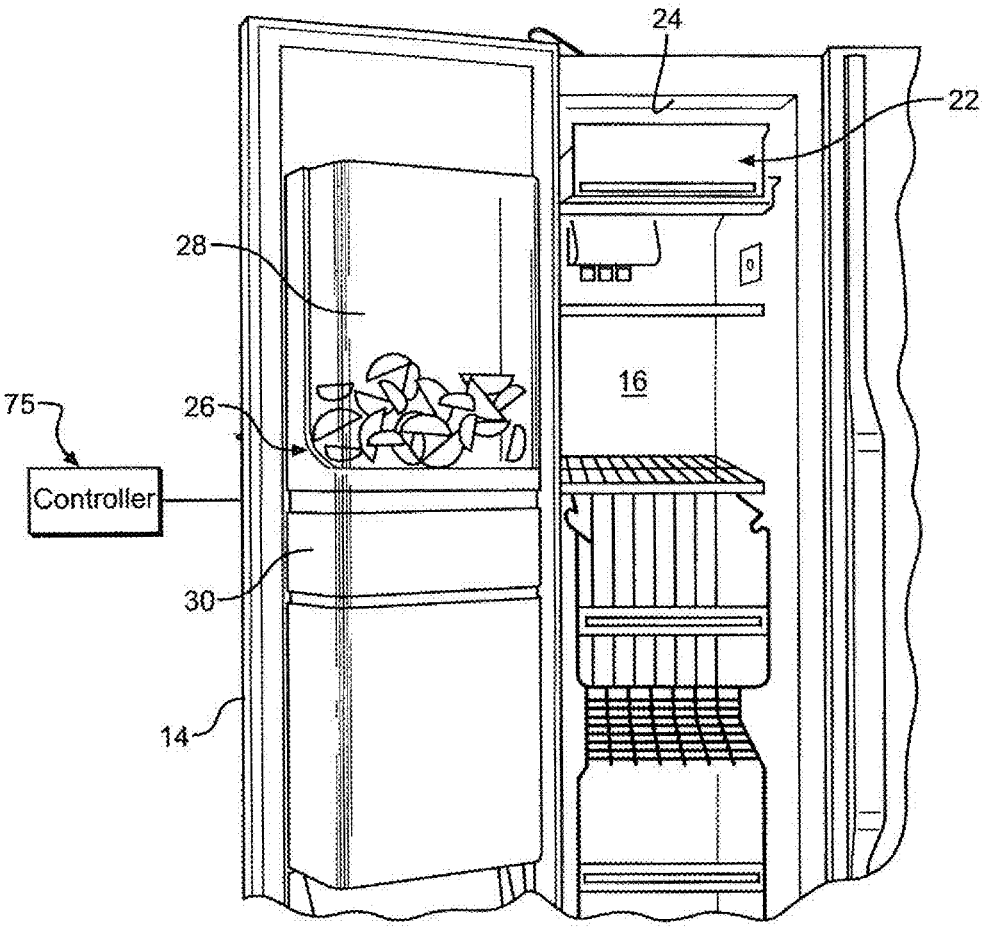
FIG. 2 is a fragmentary perspective view illustrating a freezer compartment of the refrigerator with the freezer door open.

As illustrated in FIG. 2 an ice making assembly 22 is disposed within the freezer compartment 16 and may be mounted to top wall 24 of the freezer compartment 16 as shown, to a side wall, or on freezer door 20, with each of these mounting arrangements also being known in the art. Preferably, ice making assembly 22 takes the form of a conventional ice piece making apparatus and produces generally crescent shaped ice pieces as depicted in FIG. 2. The ice makers disclosed in U.S. Pat. Nos. 4,649,717 and 5,160,094, herein incorporated by reference, are illustrative of the type of ice makers which may be used in accordance with the present invention.

Figure 3:
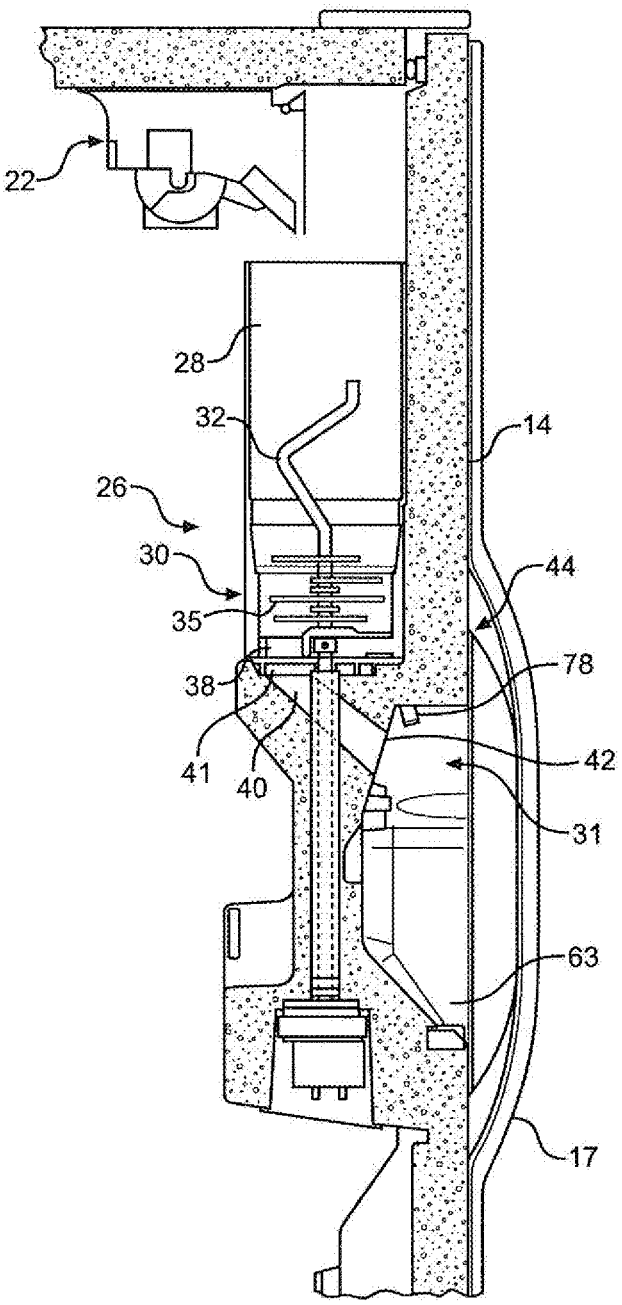
FIG. 3 is a fragmentary, side sectional view of the ice and liquid dispensing system of FIG. 1.

An ice dispensing system 26, mounted to the freezer door 20, is provided below the ice making assembly 22 for receiving ice pieces. The ice dispensing system 26 includes an ice bucket or bin 28, as well as a lower ice crushing system 30. When operated, the ice dispensing system 26 transfers ice pieces from bin 28 to ice crushing system 30 and then through the freezer door 14 whereby ice pieces may be dispensed through a forwardly exposed, external ice and liquid dispenser station or area 31. More particularly, as shown in FIG. 3, an auger 32 positioned within ice bucket 28 causes the ice pieces to pass through an inlet opening and fall into the ice crushing region 30. Rotation of auger 32 rotates crushing blades 35 resulting in the ice pieces being crushed. The crushed ice pieces, once past blades 35, fall through an outlet opening 38. Once the ice pieces, in either a whole or crushed form, are passed through the ice outlet opening 38, they fall through an ice chute 40 formed into the freezer door 14 to a waiting receptacle positioned within the service area 31. Ice chute 40 includes an entry end 41 positioned adjacent to crushing blades 35 and an ice dispensing end 42 positioned to eject ice into the service area 31.

In accordance with the invention, external ice and liquid dispenser station 31 includes a main housing 44 and a control panel 49. Control panel 49 includes first and second rows of control buttons 53 and 54 which enable a user to select a preferred dispensing operation. Control panel 49 further includes a display 57, such as an LCD display, which, in addition to functioning in cooperation with external ice and liquid dispenser station 31, enables the user to select particular operational parameters for refrigerator 2, such as desired temperatures for freezer compartment 11 and fresh food compartment 12. In any case, external ice and liquid dispenser station 31 includes a dispenser well 63 having a base or container support portion 65 and a recessed, upstanding wall section 68. Refrigerator 2 also includes an ice and liquid dispenser control system 75 for recognizing and sending an alert when a hand is in the dispensing well or ice chute.

Dispenser control system 75 automatically detects when a user has inserted a body part, particularly a hand, into at least an upper rear portion of dispenser well 63, particularly dispensing chute 40. Towards that end, dispenser control system 75 includes a digital image capture device 78 and a digital image analyzer 80, each of which is operatively coupled to a controller 85. Basically, digital image capture device detects and images objects which enter dispenser well 63. Digital images from digital image capture device 78 are passed to digital image analyzer 80 which calibrates the image and performs color and threshold based segmentation of the image in order to detect the presence of skin color in the image. If digital image analyzer 80 determines that human skin color is present in the image, the results are sent back to controller 85 which produces a signal to alert those nearby that a child or other user has inserted his or her hand into at least an upper rear region of dispenser well 63, including dispensing chute 40. The signal is preferably visually presented on display 57, but may include an audible signal. In addition, controller 85 prevents any dispensing operation. In the event that digital image analyzer system 80 determines that human skin color is not found on the image, controller 85 enables dispensing to occur, such as through the operation of ice dispensing system 26. However, if during the dispensing process, an updated image reveals a hand is now present, the dispensing process will be disabled.

Figure 4:
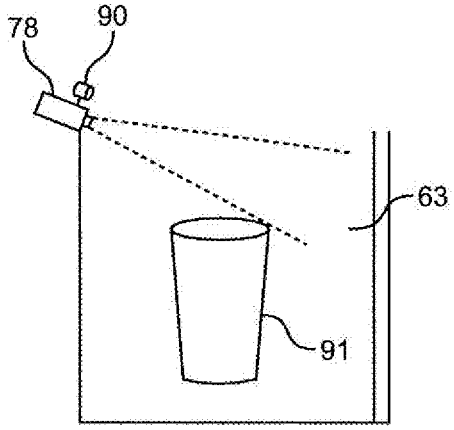
FIG. 4 is a block diagram illustrating a digital image capture device of the imaging system used to capture images of objects that enter the dispensing area in accordance with the present invention.

As best shown in FIG. 4, digital image capture device 78 preferably constitutes a digital camera that can take on a variety of forms, such as a fixed image charged/coupled device (CCD) camera, a fixed image complimentary metal oxide semiconductor (CMOS) camera or even a video camera. Digital image capture device 78 is preferably operatively connected to a light source 90 which produces light of one or more wavelengths. That is, light source 90 can bathe dispenser well 63 in white light, colored light or non-visible light depending upon a particular parameter of interest. In any case, digital image capture device 78 is angled and operated to capture digital images of objects that enter dispenser well 63. Objects in dispenser well 63 are contrasted against a reference image, e.g., the background of dispenser well 63, for clarity. In the depicted embodiment, digital image capture device 78 is positioned in an upper portion of dispenser well 63 to capture a side view of objects which may be above a container 91.

Figure 5:
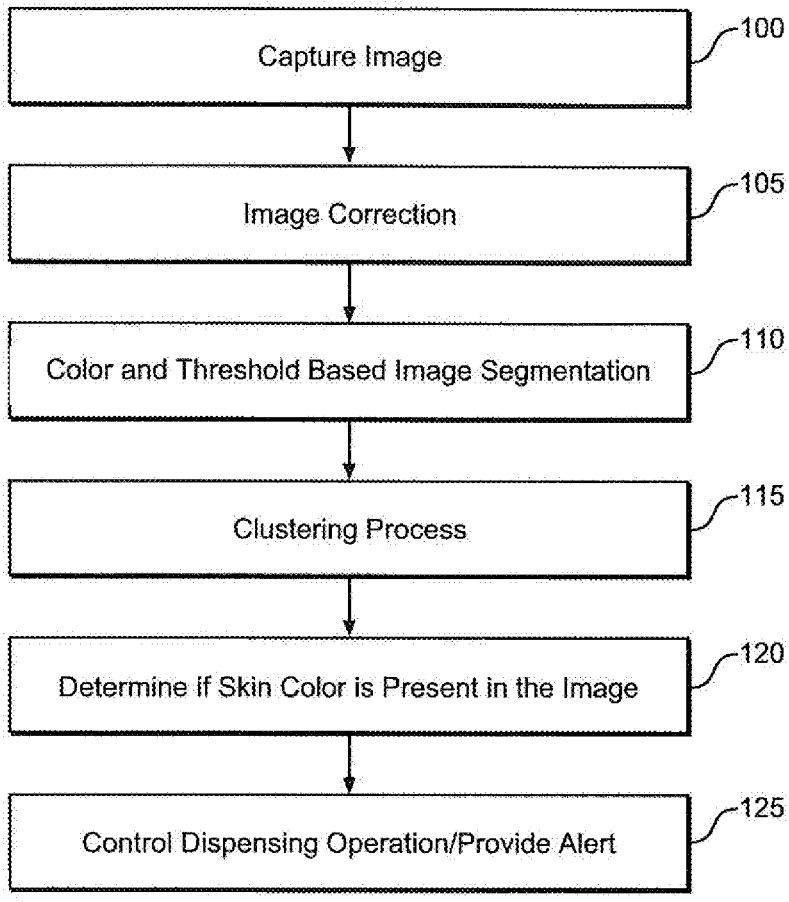
FIG. 5 is a flow chart illustrating the dispensing method according to the present invention.

In accordance with a preferred control arrangement represented in FIG. 5, digital image capture device 78 first takes a photograph, i.e., captures a digital image, of an object that enters dispenser well 63 as shown in block 100. The digital image is analyzed by digital image analyzing system 80 to determine if skin is present in the image. More specifically, an image processing algorithm is carried out to determine if skin is detected in the image. That is, in block 105, the image is first subjected to an image correction step to correct distortions in the image, such as distortions that result from the use of a fish eye lens in image capture device 78. The corrected image then undergoes color based segmentation and threshold based segmentation as shown in block 110. Following segmentation, the image segments are subjected to a clustering process in block 115 to determine a mean cluster. The resulting images are then analyzed to determine if skin color is detected in block 120. More specifically, the disclosed embodiment determines if the mean cluster is greater than a predetermined threshold. If the threshold is exceeded, there is an indication of skin color in the image and dispensing is prevented (step 125). If the mean cluster is not greater than the threshold, the control system enables a dispensing operation (also step 125). Although not shown in this figure, if the threshold is exceeded, a signal is also preferably passed to display 54 in connection with step 125 to provide notice that human skin, presumably a hand, is present in dispenser well 63.

Based on the above, it should be readily understood that the present invention enables a refrigerator to automatically detect and provide an alert when a human hand or the like has been inserted into the dispensing well. In addition to sending an alert, the system of the present invention provides for the automatic shut down of the dispensing system if the presence of a hand is detected. Although described with reference to preferred embodiments of the invention, it should be readily understood that various changes and/or modifications can be made to the invention without departing from the spirit thereof. For instance, it should be understood that the number and location of cameras can vary in accordance with the present invention. For example, cameras can be located within or simply exposed to the ice chute to capture digital images. In general, the invention is only intended to be limited by the scope of the following claims.

What is claimed is:

1. A refrigerator comprising:

a cabinet including at least one refrigeration compartment;

a door mounted to the cabinet for selectively providing access to the refrigeration compartment;

a dispenser provided in the door for selectively performing a dispensing operation, said dispenser including a dispenser well;

a digital image capture device exposed to said dispenser well for capturing digital images of objects introduced into said dispenser well;

a digital image analyzing system operatively connected to the digital image capture device, said digital image analyzing system being adapted to evaluate the digital images captured by the digital image capture device to determine a presence of human skin in said digital images; and a controller for regulating the dispensing operation based on an output of the digital image analyzing system wherein the controller prevents operation of the dispenser if human skin is detected before operation of the dispenser and stops operation of the dispenser if human skin is detected during the dispensing operation.

2. The refrigerator according to claim 1, wherein said digital image analyzing system is adapted to determine the presence of human skin in the digital images by detecting a color of human skin.

3. The refrigerator of claim 2, wherein the digital image analyzing system employs image segmentation to distinguish objects in the dispensing well.

4. The refrigerator according to claim 1, further comprising:

an icemaker disposed within the refrigeration compartment for producing ice cubes;

an ice bucket for receiving ice cubes produced by the icemaker;

an ice crushing mechanism provided to selectively crush ice cubes from the ice bucket; and an ice chute provided in the door for delivering ice from the ice crushing mechanism to the dispenser, said ice chute having an ice entry end and an ice dispensing end, said digital image capture device being exposed to take the digital images directly adjacent the ice dispensing end of the ice chute, wherein the controller prevents operation of the ice crushing mechanism when the output of the digital image analyzing system indicates the presence of human skin in the dispensing well.

5. The refrigerator according to claim 1, wherein the digital image capture device constitutes a still image camera.

6. The refrigerator according to claim 5, wherein the digital image capture device is a charged/coupled device (CCD) camera.

7. The refrigerator according to claim 5, wherein the digital image capture device is a complementary metal oxide semiconductor (CMOS) camera.

8. The refrigerator according to claim 1, wherein the digital image capture device constitutes a video camera for capturing video images.

9. The refrigerator according to claim 1, wherein the digital image capture device includes a light source for illuminating the dispenser well for imaging purposes.

10. The refrigerator according to claim 1, wherein the digital image capture device is mounted at one side in the dispensing well.

11. The refrigerator according to claim 1, further comprising: an alert signaler, wherein the controller provides an alert signal when the output of the digital image analyzing system indicates the presence of human skin in the dispensing well.

12. In a refrigerator including: a cabinet including at least one refrigeration compartment; a door mounted to the cabinet for selectively providing access to the refrigeration compartment; a dispenser provided in the door for selectively performing a dispensing operation, said dispenser including a dispenser well; a digital image capture device exposed to said dispenser well for capturing digital images of objects introduced into said dispenser well; a digital image analyzing system operatively connected to the digital image capture device, said digital image analyzing system being adapted to evaluate the digital images captured by the digital image capture device to determine a presence of human skin in said digital images; and a controller for regulating the dispensing operation based on an output of the digital image analyzing system, a method of controlling the dispensing operation in the dispenser well of the refrigerator comprising:

capturing an image of an object in the dispensing well;

processing said image to determine if human skin is detected in said image; and controlling the dispensing operation when human skin is detected in the image wherein controlling the dispensing operation constitutes preventing the dispensing operation if human skin is detected before operating the dispenser and stopping the dispensing operation if human skin is detected during the dispensing operation.

13. The method of claim 12, wherein the refrigerator includes an icemaker, an ice crushing mechanism and a chute leading from an inlet at the ice crushing mechanism to an outlet at the dispensing well, said image being captured directly adjacent the outlet.

14. The method of claim 12, further comprising: automatically generating an alert signal if human skin is detected in the image.

15. The method of claim 12, wherein processing said image includes segmenting the image.

16. The method of claim 12, further comprising: operating a light source to illuminate the object in the dispensing well for imaging purposes.

17. The method of claim 16, wherein processing said image to determine if human skin is detected in said image includes detecting a color of human skin in the image.

* * * * *